US005553789A

United States Patent [19]

Findler et al.

[11] Patent Number: 5,553,789

[45] Date of Patent: Sep. 10, 1996

[54] ORIFICE ELEMENT

[75] Inventors: Guenther Findler, Stuttgart; Juergen Buchholz, Lauffen; Udo Jauernig, Reutlingen, all of Germany

[73] Assignee: Robert Bosch GmbH, Stuttgart, Germany

[21] Appl. No.: 308,319

[22] Filed: Sep. 19, 1994

[30] Foreign Application Priority Data

Oct. 1, 1993 [DE] Germany ..... 43 33 519.5

[51] Int. Cl.[6] ..... A62C 2/08

[52] U.S. Cl. ..... 239/548; 239/585.1; 239/596

[58] Field of Search ..... 239/548, 533.1, 239/585.1, 596

[56] References Cited

U.S. PATENT DOCUMENTS 5,035,358 7/1991 Katsuno et al. ..... 239/585.1
5,397,061 3/1994 Buchholz et al. ..... 239/408
5,421,952 6/1995 Buchholz et al. ..... 216/33

FOREIGN PATENT DOCUMENTS 4112150 3/1992 Germany .
4233703 4/1994 Germany .

*Primary Examiner*—Andres Kashnikow
*Assistant Examiner*—Lisa Douglas
*Attorney, Agent, or Firm*—Kenyon & Kenyon

[57] ABSTRACT

A silicon orifice element includes an upper silicon plate and a lower silicon plate. A liquid can be injected through injection orifices of the upper silicon plate. Recesses which form air conduits are present in the lower silicon plate. The atomization and spray angle of the liquid stream passing through the injection orifices can be influenced by certain arrangements of the air conduits.

15 Claims, 3 Drawing Sheets

ORIFICE ELEMENT

FIELD OF THE INVENTION

The present invention relates to an orifice element and in particular to a silicon orifice element.

BACKGROUND INFORMATION

German Patent Application No. DE 41 12 150 describes an orifice element that has an upper and a lower silicon plate made of monocrystalline silicon. Four injection orifices are arranged in the upper silicon plate, and one large common passthrough orifice is arranged in the lower silicon plate. Recesses that extend from the passthrough orifice to the outer periphery of the lower silicon plate, and thus form air conduits, are introduced into the lower silicon plate. An orifice element of this kind can be used for injection nozzles if a liquid stream is delivered through the injection openings, and a gas stream through the air conduits. The gas stream improves atomization of the liquid stream.

German Patent Application No. DE 42 33 703 describes a cost-effective method for processing the lower silicon plate of an orifice element of this kind. Processing is accomplished by simultaneous chemical etching from both sides of the lower silicon plate.

SUMMARY OF THE INVENTION

Flow conditions for the atomization of liquids by means of an orifice element can be optimized by associating one injection orifice with each passthrough orifice, according to the principles of the present invention.

It is advantageous to configure the side walls of the passthrough orifices in such a way that simultaneous two-sided processing of the lower silicon plates is possible, since manufacturing costs can thereby be reduced. A favorable arrangement is based on four injection orifices, since as a result each passthrough orifice can be reached by air conduits from two sides. A cruciform joining surface between the upper and lower silicon plates can keep the joining surface between the two plates large, and thus improve mechanical strength. When the air conduits are configured with side walls that are parallel to the side walls of the passthrough orifices, the manufacturing processes for the passthrough orifices can also be used for the air conduits.

By arranging two air conduits for each passthrough orifice, the spray angle of a liquid sprayed through the spray orifices is influenced toward smaller spray angles. A similar reduction in spray angle is achieved by arranging one air conduit in each outer corner of the passthrough orifices. An arrangement of the air conduits each at the edge regions of the passthrough orifices causes a swirl to be imparted to the liquid streams entering through the four injection orifices, so that a favorable compromise between droplet size and liquid spray angle is achieved. An arrangement of four air conduits, each passthrough orifice being connected at two opposite corners to an air conduit, achieves particularly good atomization of a liquid sprayed through the injection orifices. It is especially advantageous in this context that this small droplet diameter is attained immediately after injection. A small droplet diameter is also achieved with passthrough orifices such that two air conduits are associated at opposite corners of each one.

DETAILED DESCRIPTION

Figure 1:
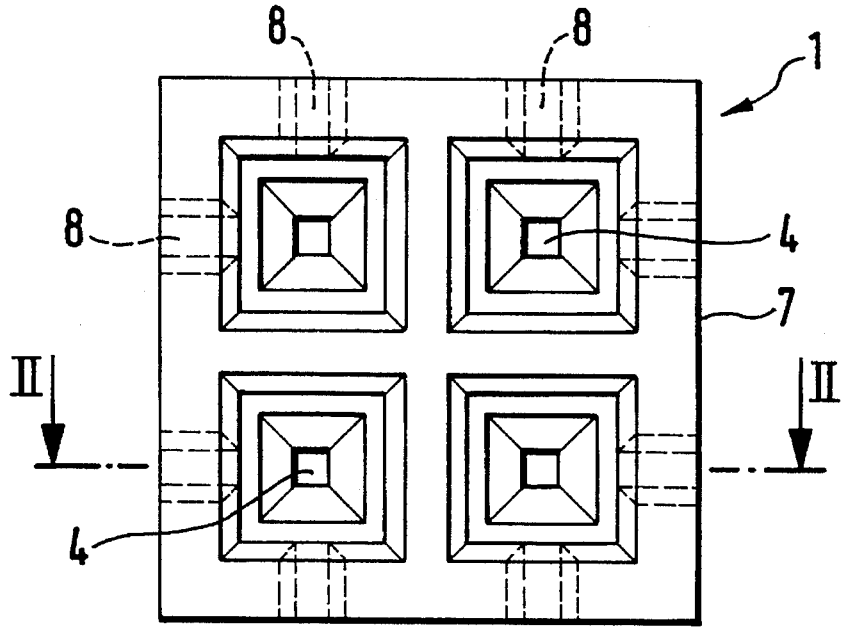
FIG. 1 shows a bottom view of a first exemplary embodiment of the orifice element according to the present invention.
Figure 2:
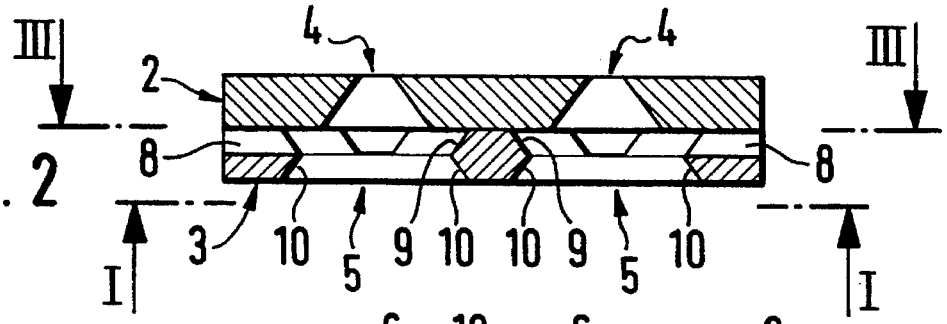
FIG. 2 shows a cross sectional view of the orifice element of FIG. 1.

FIGS. 1 and 2 show a first exemplary embodiment of the orifice element according to the present invention. FIG. 1 shows a bottom view, along line I—I of FIG. 2, of the orifice element 1. FIG. 2 shows a cross section, along line II—II of FIG. 1, of orifice element 1. Orifice element 1 is constructed from an upper silicon plate 2 and a lower silicon plate 3. Four injection orifices 4 are introduced into upper silicon plate 2. Lower silicon plate 3 has four passthrough orifices 5, one passthrough orifice 5 being associated with each injection orifice 4. Furthermore, lower silicon plate 3 is configured so as to create air conduits 8 which connect passthrough orifices 5 with the outer periphery 7 of orifice element 1. It is evident from FIG. 1 that two air conduits 8, each of which opens into the outer sides of passthrough orifices 5, are associated with each passthrough orifice 5. Passthrough orifices 5 each have upper side walls 9 and lower side walls 10. The side walls 9, 10 each form an angle of approximately 108 degrees with one another.

Injection openings 4 in upper silicon plate 2 each have a trapezoidal cross section. Such openings can be achieved particularly easily by anisotropic silicon etching in {100}-oriented silicon. The side walls of injection orifices 4 include {111} crystal surfaces of the silicon monocrystal. The side walls of injection orifices 4 are at an angle of approximately 54 degrees to the surface of upper silicon plate 2. Manufacturing processes to manufacture lower silicon plate 3 are described in detail in German Patent Application No. DE 42 33 703. Simultaneous processing of both sides of lower silicon plate 3 creates side walls 9, 10, each of which includes {111} crystal surfaces of the silicon monocrystal. The side walls 9, 10 each have an angle of approximately 54 degrees to the surfaces of lower silicon plate 3, oriented in the {100} axis. Because of this arrangement, side walls 9, 10 have an angle of approximately 108 degrees to one another.

Figure 3:
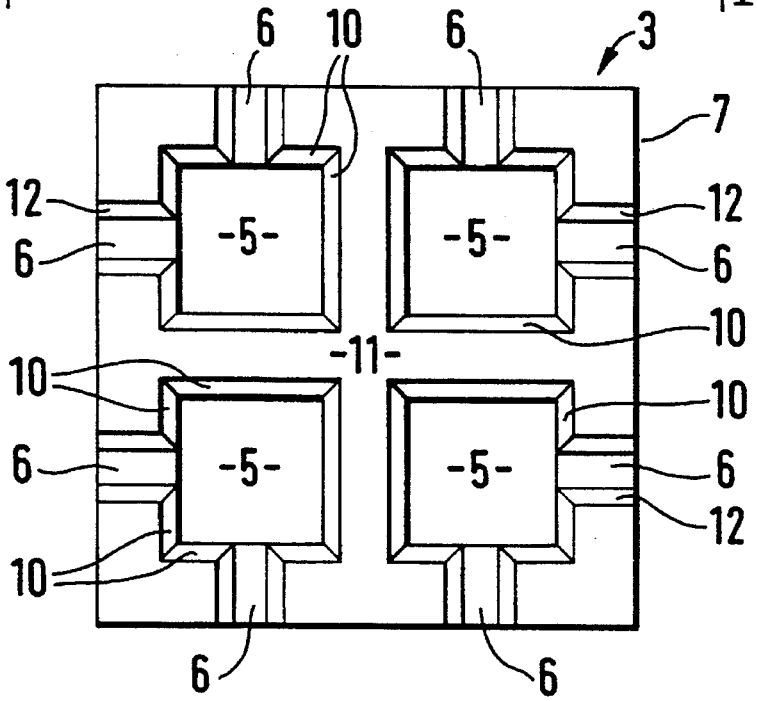
FIG. 3 shows a top view of the lower silicon plate of the orifice element of FIG. 1.
Figure 4:
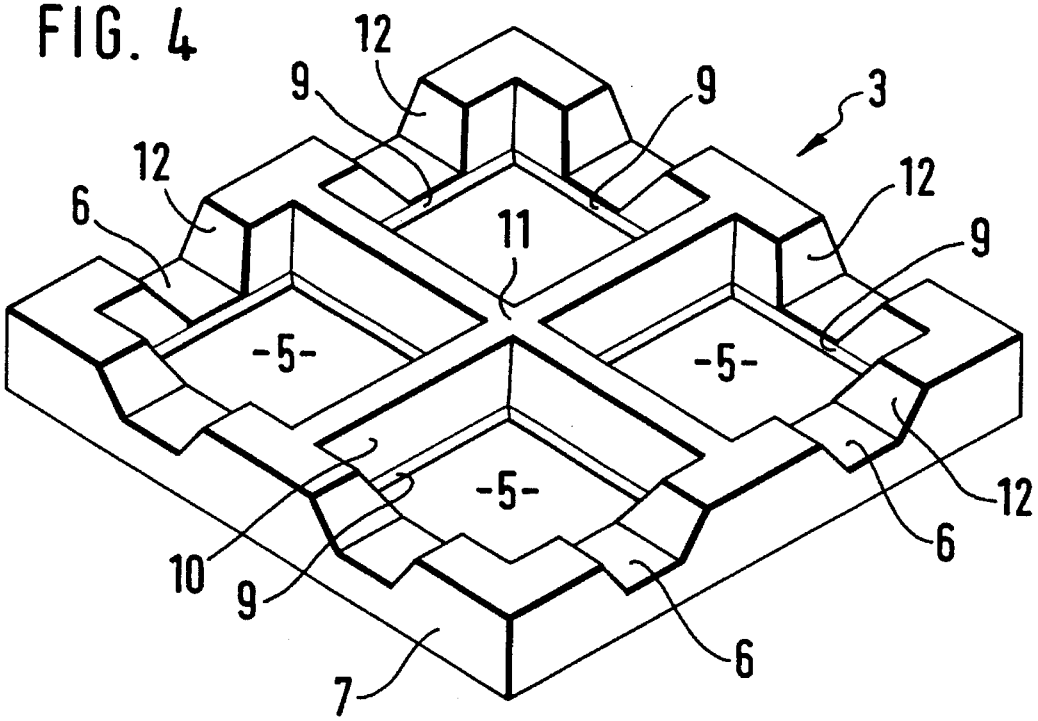
FIG. 4 shows a perspective view of the lower silicon plate of FIG. 3.

FIG. 3 shows a top view of lower silicon plate 3 along line III—III of FIG. 2. FIG. 4 shows lower silicon plate 3 in a perspective view. As is evident, recesses 6 are introduced into lower silicon plate 3, each extending from passthrough orifices 5 to outer edge 7 of silicon plate 3. Recesses 6 have side walls 12 that are each parallel to upper side walls 10 of passthrough orifices 5. Recesses 6 are manufactured with the same methods by which passthrough orifices 5 are etched into lower silicon plate 3. By joining lower silicon plate 3 and upper silicon plate 2, recesses 6 are closed off in such a way as to produce air conduits 8. Remaining between passthrough orifices 5 is a cruciform joining region 11 by which lower silicon plate 3 is also joined to upper silicon plate 2. This joining region 11 produces a join between the two silicon plates 2, 3 that is particularly mechanically stable even between passthrough orifices 5.

The orifice element shown in FIGS. 1 to 4 can advantageously be used to inject and atomize liquids, as is described for example in German Patent Application No. DE 41 12 150. A liquid, in particular gasoline, is then injected through injection opening 4, and is then finely atomized by an air stream that is blown or drawn in by means of air conduits 8. It is desirable in this context to be able to influence the spray angle of the emerging liquid and the droplet size resulting from atomization. The spray angle must be adapted in each case to the geometrical conditions of the installation location. For atomization, a particularly small droplet diameter is advantageous. These two parameters can be influenced particularly well if a passthrough orifice 5 with air conduits 8 is associated with each injection orifice 4. In the arrangement shown in FIGS. 1—4, not only is good atomization guaranteed by air conduits 8, but compression of the liquid streams entering through the four injection orifices 4—i.e. a reduction in spray angle—is also achieved.

FIGS. 5 to 10 show further exemplary embodiments of lower silicon plates 3. To complete the orifice element, these lower silicon plates 3 are joined in each case to an upper silicon plate 2 as described in FIGS. 1 and 2. The lower silicon plates 3 are manufactured in a manner similar to that described with reference to FIGS. 1 to 4 and in German Patent Application No. DE 42 33 703. Once again upper and lower side walls 9, 10 are formed, located at an angle of approximately 108 degrees to one another. Side walls 12 of recesses 6 are in turn parallel to the upper side walls 9 of passthrough orifices 5.

Figure 6:
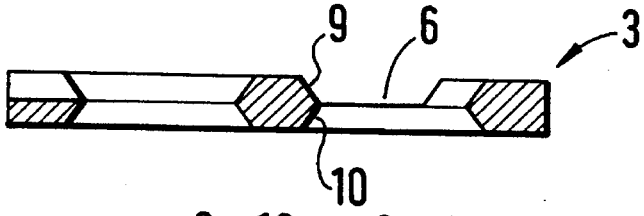
FIG. 6 shows a cross-sectional view of the lower silicon plate of FIG. 5.
Figure 5:
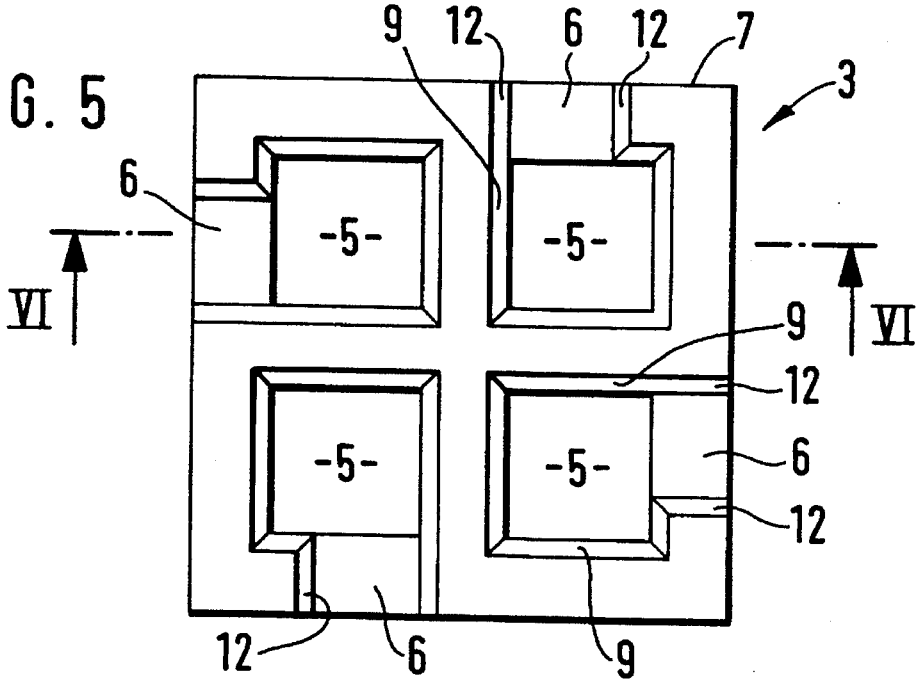
FIG. 5 shows a top view of a lower silicon plate in a second exemplary embodiment of the orifice element according to the present invention.

FIGS. 5 and 6 show a top view of and a cross section through a further exemplary embodiment of a lower silicon plate 3. The cross section in FIG. 6 corresponds to a view through silicon plate 3 along line VI—VI of FIG. 5. The silicon plate 3 in turn has four passthrough orifices 5. Lower silicon plate 3 shown here in turn has recesses 6 which connect passthrough orifices 5 to the outer border 7 of silicon plate 3. The recesses 6 in turn form air conduits 8. In silicon plate 3 shown here, an arrangement of recesses 6 relative to passthrough orifices 5 is shown which produces air conduits 8 that asymmetrically strike the liquid stream passing through injection orifices 4. This feature imparts a certain swirl to each liquid stream entering through injection orifices 4, so that the four liquid streams are interlaced with one another to a certain extent. This arrangement produces good atomization along with a small spray angle. Recesses 6 are depicted here in such a way that side walls 12 of recesses 6 align with side walls 9 of passthrough orifices 5. However any arrangement in which air conduits 8 are arranged offset from injection orifices 4, so that a swirl is imparted to the entering liquid stream, is equally imaginable.

Figure 8:
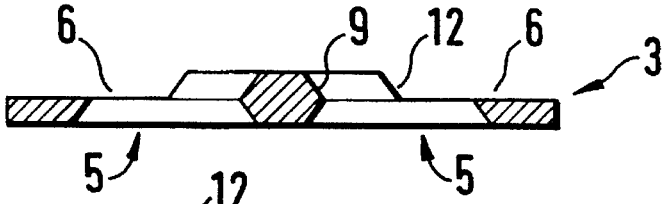
FIG. 8 shows a cross-sectional view of the lower silicon plate of FIG. 7.
Figure 7:
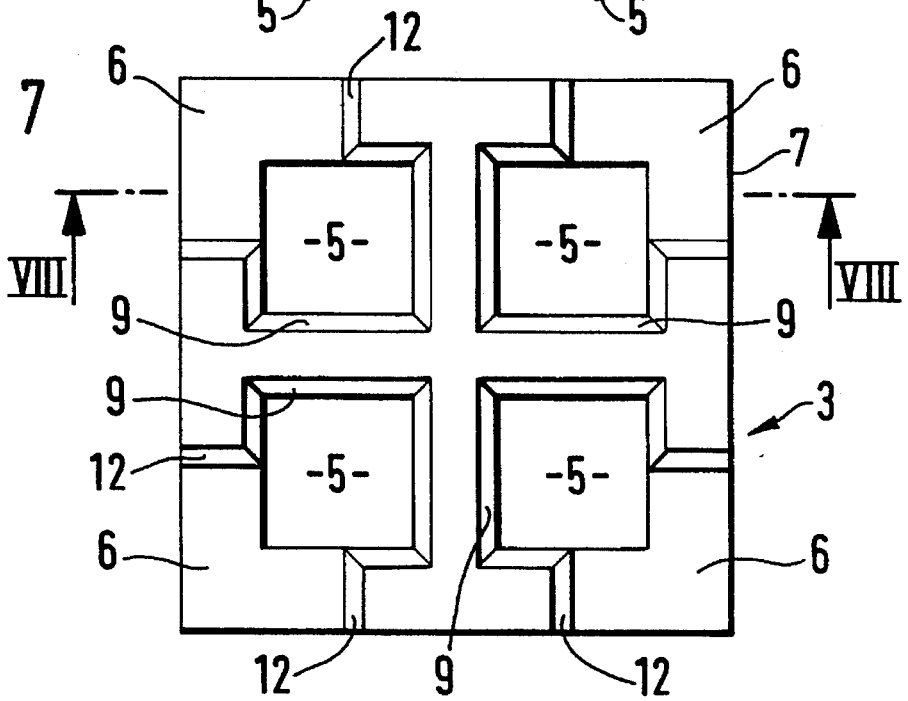
FIG. 7 shows a top view of a lower silicon plate in a third exemplary embodiment of the orifice element according to the present invention.

FIGS. 7 and 8 show a further exemplary embodiment of lower silicon plate 3. FIG. 7 shows a top view of silicon plate 3, and FIG. 8 shows a cross section along line VIII—VIII. Introduced into silicon plate 3 are recesses 6 which are in contact, each at one corner, with passthrough orifices 5. The recesses 6 thus form air conduits 8, each of which introduces an air stream at the corners of passthrough orifices 5. The liquid streams entering through the four injection orifices 4 are thus pressed together by the air stream. A particularly small spray angle for these liquid streams can therefore be achieved with this arrangement. Side walls 12 of recesses 6 are in turn parallel, to the upper side walls 9 of passthrough orifices 5. The silicon plate 3 is again manufactured as described with reference to FIGS. 1 to 4.

Figure 10:
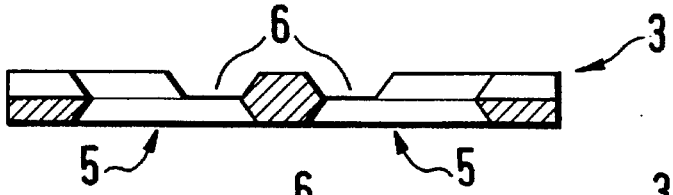
FIG. 10 shows a cross-sectional view of the lower silicon plate of FIG. 9.
Figure 9:
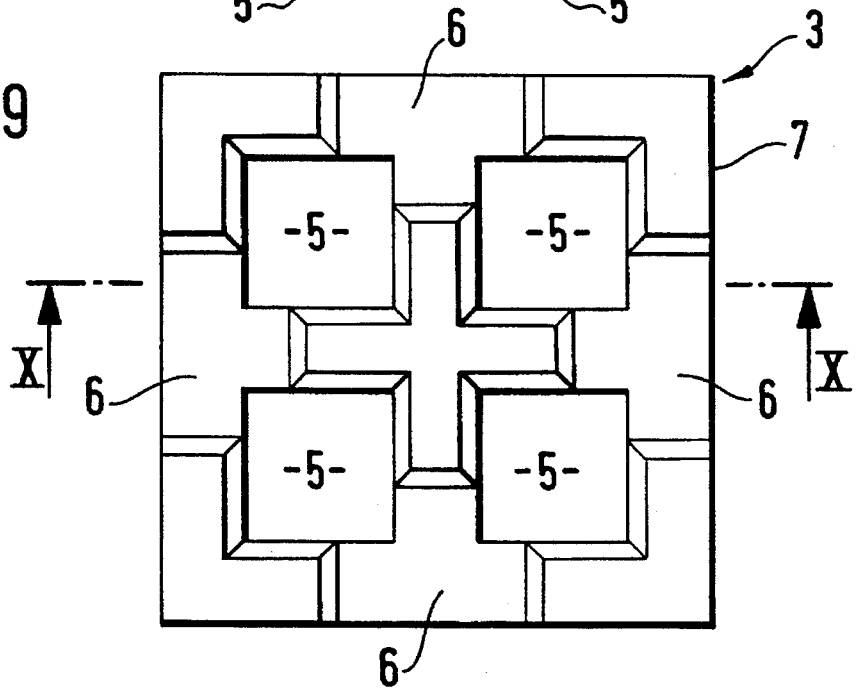
FIG. 9 shows a top view of a lower silicon plate in a fourth exemplary embodiment of the orifice element according to the present invention.

FIGS. 9 and 10 show a further exemplary embodiment of a silicon plate 3. Recesses 6, through which passthrough orifices 5 are connected to outside 7 of silicon plate 3, are again introduced into the silicon plate 3. The recesses 6 form air conduits 8 that each allow one air stream to enter at opposite corners of passthrough orifices 5. The two entering air streams are thus directed approximately opposite to one another. This arrangement of two air conduits in such a way that the air flows are opposite to one another produces particularly good atomization of the liquid entering through injection orifices 4.

In the arrangement shown here for four injection orifices 4 with four passthrough orifices 5 that are arranged quadratically, this is achieved particularly easily in terms of the design, by the fact that recesses 6 which each connect two passthrough orifices 5 to outside 7 of silicon plate 3 are provided. In this manner, each of passthrough orifices 5 is provided particularly easily with two air conduits 8, which lie at opposite corners of the rectangular passthrough orifices 5 shown here. Also particularly advantageous here is the fact that good atomization, i.e. the small size of the resulting liquid droplets, is already produced directly in passthrough orifice 5, and not later in the course of the liquid stream's travel. Good atomization of this kind is achieved when two air conduits 8, which act on the liquid stream entering through injection orifices 4, are provided. The arrangement shown in FIGS. 9 and 10 of injection orifices 4 and air conduits 8 for four injection orifices is therefore also analogously possible for other arrangements of injection orifices or even one individual injection orifice.

What is claimed is:

1. An orifice element comprising:

an upper silicon plate having a plurality of injection orifices;

a lower silicon plate joined to the upper silicon plate, the lower silicon plate having a plurality of passthrough orifices, each of the plurality of passthrough orifices being associated with a respective one of the plurality of injection orifices, the lower silicon plate further having a plurality of recesses, each of the plurality of recesses extending from at least one of the plurality of passthrough orifices to an outer periphery of the lower silicon plate, the recesses forming conduits between the lower and upper silicon plates.

2. The orifice element according to claim 1, wherein the upper and lower silicon plates include monocrystalline silicon.

3. The orifice element according to claim 1, wherein the conduits are air conduits.

4. The orifice element according to claim 3, wherein the air conduits are recessed into the lower silicon plate adjacent to the upper silicon plate.

5. The orifice element according to claim 1, wherein:

the lower silicon plate has a top surface and a bottom surface;

each of the passthrough orifices has at least one upper side wall extending from the top surface of the lower silicon plate to half-way between the top and bottom surfaces of the lower silicon plate; and each of the passthrough orifices further has at least one lower side wall extending from the bottom surface of the lower silicon plate to half-way between the top and bottom surfaces of the lower silicon plate.

6. The orifice element according to claim 5, wherein the upper and lower side walls form an angle of approximately 108 degrees with respect to one another.

7. The orifice element according to claim 5, wherein each of the recesses has at least one side wall parallel to the upper side wall of a respective one of the passthrough orifices.

8. The orifice element according to claim 1, wherein the upper silicon plate has four injection orifices arranged as corners of a rectangle.

9. The orifice element according to claim 8, wherein the passthrough orifices are arranged in a rectangular configuration.

10. The orifice element according to claim 1, further comprising a cruciform joining structure for joining the upper and lower silicon plates between the passthrough orifices.

11. The orifice element according to claim 1, wherein two conduits extend to first and second sides of each of the passthrough orifices at right angles.

12. The orifice element according to claim 1, wherein each conduit extends to a corner of a respective one of the passthrough orifices.

13. The orifice element according to claim 1, wherein each conduit extends to a side of a respective one of the passthrough orifices at a right angle, such that a gas stream introduced through the conduit strikes, at an offset, a liquid stream introduced through the respective passthrough orifice, thereby imparting a swirl to the liquid stream.

14. The orifice element according to claim 1, wherein each of four conduits extends to corners of a respective pair of adjacent passthrough orifices.

15. An orifice element comprising:

an upper silicon plate having at least one injection orifice;

a lower silicon plate joined to the upper silicon plate, the lower silicon plate having at least one passthrough orifice opposite the injection orifice;

at least two air conduits being disposed between the upper and lower silicon plates, the two air conduits extending from opposite sides of the passthrough orifice, such that the two air conduits are adapted to carry respective air streams moving in opposite directions.

* * * * *